US007350942B2

(12) United States Patent
Chen et al.

(10) Patent No.: US 7,350,942 B2
(45) Date of Patent: Apr. 1, 2008

(54) LED MATRIX DISPLAY MODULE WITH HIGH LUMINANCE AREA RATIO

(75) Inventors: Bishou Chen, Shanghai (CN); Yinghua Wang, Shanghai (CN); Peng Wang, Shanghai (CN); Xiaoliang He, Shanghai (CN)

(73) Assignee: Shanghai Sansi Technology Co., Ltd., Shanghai (CN)

( * ) Notice: Subject to any disclaimer, the term of this patent is extended or adjusted under 35 U.S.C. 154(b) by 0 days.

(21) Appl. No.: 11/484,360

(22) Filed: Jul. 11, 2006

(65) Prior Publication Data

US 2007/0019411 A1 Jan. 25, 2007

Related U.S. Application Data

(63) Continuation of application No. PCT/CN2005/000089, filed on Jan. 19, 2005.

(30) Foreign Application Priority Data

Jan. 19, 2004 (CN) ..... 2004 2 0019735 U

(51) Int. Cl.
*F21V 7/00* (2006.01)

(52) U.S. Cl. ..... 362/347; 362/227; 362/235; 362/241; 362/243; 362/446; 362/450; 362/451; 40/446; 40/451; 40/454; 40/456; 345/46

(58) Field of Classification Search ..... 362/450, 362/235, 241, 243, 451, 446, 227, 247, 296, 362/297, 341; 40/451, 454, 456, 446
See application file for complete search history.

(56) References Cited

U.S. PATENT DOCUMENTS 5,660,461 A * 8/1997 Ignatius et al. ..... 362/241
6,403,391 B1 6/2002 Nishimura et al.
6,527,411 B1 * 3/2003 Sayers ..... 362/245

(Continued)

FOREIGN PATENT DOCUMENTS

CA 1254987 5/1989

(Continued)

*Primary Examiner*—Stephen F. Husar
*Assistant Examiner*—Meghan K. Dunwiddie
(74) *Attorney, Agent, or Firm*—Dorsey & Whitney LLP

(57) ABSTRACT

The invention relates to a display apparatus, particularly to structure of LED display modules. The invention could be implemented through a LED matrix display module with high luminance area ratio comprising an injection molding unit and a printing board fitted therewith, wherein, LEDs are regularly arranged in a matrix on said printing board, and each pixel dot is correspondingly provided with a reflecting cavity on said molding unit, with the reflecting cavity expanding gradually from the inside section (close to the display surface). The circumference of the inside section of the reflecting cavity forms a closed and smooth circular curve. The invention is characterized in that, the circumference of the outside section of the reflecting cavity forms a closed and smooth curve which is a square with round corners, and the side face of the reflecting cavity is a smooth and cured surface. The invention is advantageous because the luminance area ratio could be significantly improved when the area formed by the circumference of the outside section of the reflecting cavity, which is a square with round corners, was large enough.

2 Claims, 2 Drawing Sheets

U.S. PATENT DOCUMENTS 7,008,079 B2 * 3/2006 Smith ..... 362/235
7,008,080 B2 * 3/2006 Bachl et al. ..... 362/249

FOREIGN PATENT DOCUMENTS

CN 1132891 10/1996
CN 1134007 10/1996
CN 2598077 1/2004

* cited by examiner

LED MATRIX DISPLAY MODULE WITH HIGH LUMINANCE AREA RATIO

CROSS-REFERENCE TO RELATED APPLICATION(S)

This application is a continuation of International application number PCT/CN2005/000089, filed Jan. 19, 2005 which claims priority to Chinese application No. CN 200420019735.0 filed Jan. 19, 2004, the contents of both are herein incorporated in their entirety by reference.

FIELD OF THE INVENTION

This invention relates to a display apparatus, particularly to structure of LED display modules.

BACKGROUND OF THE INVENTION

The image is composed of a large number of pixels arranging according to specified matrix, LED display panel is composed of many LED display modules, and LED display module is composed of several pixels that independently form the smallest element of LED display panel in structure. Recently, the most common 3 types of LED display modules are as follows:

1. Matrix module structure: LEDs are regularly arranged in a matrix on the printed board. Whilst the back of printed board is vertically inserted into with the several metal needle-type pins, the front of printed board is covered with the injection molding unit. All luminous points of every pixel on said injection molding unit are equipped with reflecting cavities whose internal diameters are smaller than their external diameters in order to increase the luminance. A LED matrix display module is formed when the matrix module is filled with epoxy resin during fabrication.

2. Surface mount lamps structure: Surface mount lamps structure is also called as SMD type structure, whose each pixel is an independently filling SMD type LED containing luminous LED chip, metallic pins and reflecting cavity. Each pixel arranged in matrix is soldered on the matrix printed board with special soldering technology to form a LED display module.

3. The display module of luminous pixel composed of LED single lamp. As to a LED matrix module, when it is observed from the front of LED display panel, the inside section of the reflecting cavity of each pixel dot (close to the printed board) and the outside section (close to the display panel surface) are two cavities of different diameters, that look like a round disk being smaller inside, and bigger outside, the outside is acted as the luminous surface of the pixel dot. Because the manufacturing cost of the LED display panel is nearly proportional to the quantity of pixels, the resolution of the display panel is generally so designed as to reach the critical state of display effect that human eyes can accept. Therefore, the unavoidable black areas are formed between the luminous areas of each pixel. The influence of the black area on the display can be described as luminance area ratio (that is also called as fill factor). Luminance area ratio is the proportion between the luminous areas of each pixel on the display panel and the occupation area of each pixel on the display panel. The bigger the luminance area ratio is, the smaller the black area is and the better display effect is.

TCO has taken the pixel resolution or luminance area ratio in the display industry and flat display field as an important index to measure the display quality. According to the stipulation of TCO'99 Standard, luminance area ratio must be not less than 0.5. Moreover the pixel density must be not less than 30 pixel/degree as stipulated in TCO'03.

(TCO stems from Swedish language "Tianstemannens Centralorganlsatlon", English translation is "The Swedish Confederation of Professional Employees", which is called "SCPE" for short. With the issue of TCO Development of safety and environment protection standard for computer equipment in 1992, TCO Development has been widely recognized all over the world. Recently TCO Development is one of the most common developments generally acknowledged in the display industry.)

All display panels have the defects of small luminous area and bigger black area for all display module structures, either dot matrix structure, LED single diode structure or SMD structure in LED display panel field, therefore, the luminance area ratios are lower. As per estimation, the average luminance area ratio of a SMD type full color display panel with 10 mm pitch, 2.2 mm diameter of each luminous point is only 0.076; maximum luminance area ratio is just 0.11 as well. Even though the luminance area ratio of matrix structure is much higher than that of SMD structure, its luminance area ratio is not high. The sample of LED cluster D5 mm is taken as follows:

Common pitch 7.525 mm, the luminance area ratio:

$$\frac{\pi(5/2)^2}{7.525^2} = 0.34$$

Compact pitch 6.33 mm, the luminance area ratio:

$$\frac{\pi(5/2)^2}{6.33^2} = 0.49$$

All the above values are lower than a commonly recognized value of 0.5.

SUMMARY OF THE INVENTION

The invention aims at the design of LED matrix module structure, expanding the outside section surface of the injection molding unit reflecting cavity through the change of connection fixed mode between injection molding unit and printed board in order to increase the luminous area and luminance area ratio, thus it becomes a LED matrix display module with high luminance area ratio to reduce the black area, upgrade and improve the display effect without the change of the resolution.

The invention is implemented through a LED matrix display module with high luminance area ratio comprising an injection molding unit and printed board fitted therewith, wherein, LEDs are regularly arranged in a matrix on said printed board, and each pixel dot is correspondingly provided with a reflecting cavity on said injection molding unit, with the reflecting cavity expanding gradually from the inside section (close to the printed board) to the outside section (close to the display surface). The circumference of the inside section of the reflecting cavity forms a closed and smooth circular curve. The invention is characterized in that, the circumference of the outside section of the reflecting cavity forms a closed an smooth curve, which is a square with round corners, and the side of reflecting cavity is a smooth and curved surface.

The inside section circumference of said reflecting cavity may also form a closed and smooth curve for a square with round corners.

The advantage of this invention is that the luminance area ratio can be significantly increased when the area formed by the circumference of the outside section of the reflecting cavity, which is a square with round corners, is large enough.

BRIEF DESCRIPTION OF THE DRAWINGS

In the following a further description of this invention will be made with reference to the preferred embodiments.

DETAILED DESCRIPTION OF THE PREFERRED EMBODIMENTS

Figure 1:
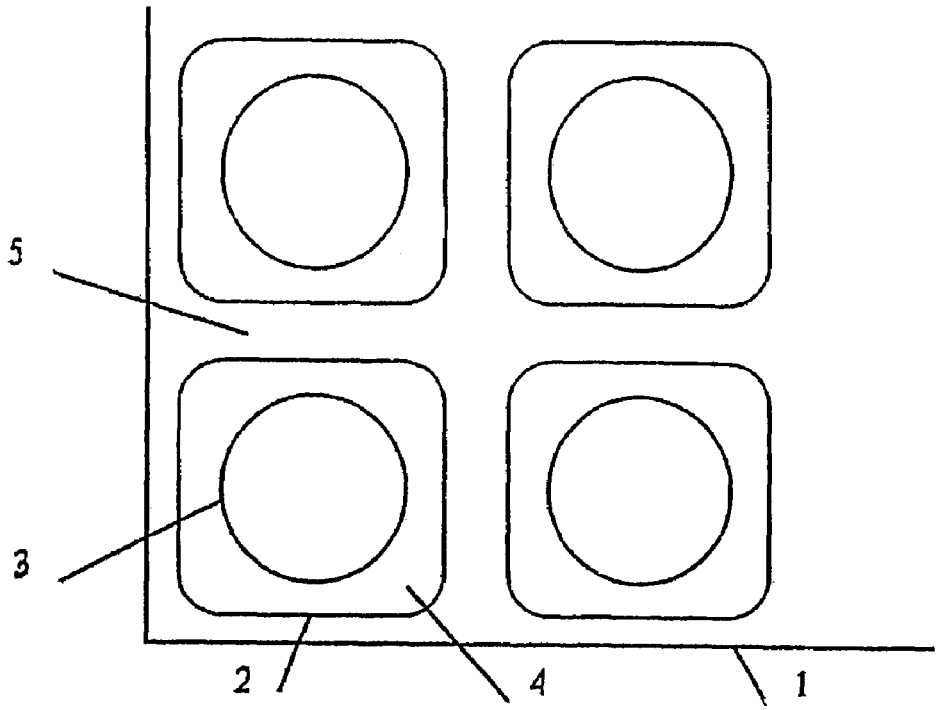
FIG. 1 is the front view of the pixel reflecting cavity of the injection molding unit (one corner).

The further description of the invention combined with the attached figures is as follows:

1 The side edge of the injection molding unit

2 The outside section circumference of the reflecting cavity

3 The inside section circumference of the reflecting cavity

4 The side surface of the reflecting cavity

5 Black areas

6 The boundary of the pixel physical area

Figure 2:
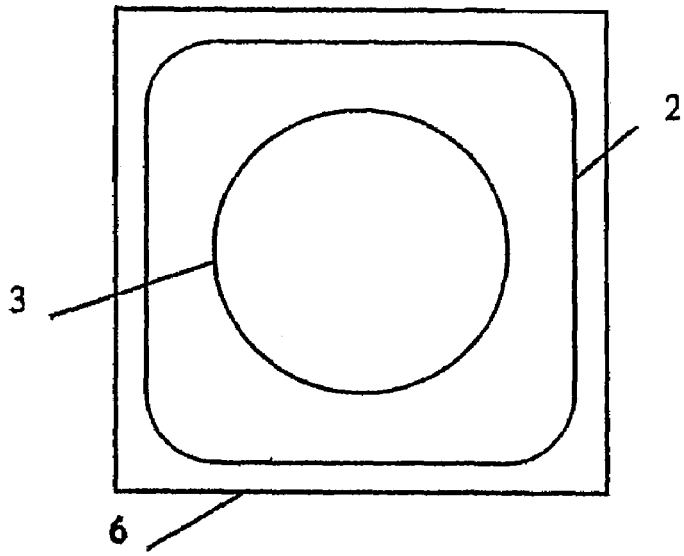
FIG. 2 is the effect figure sample of the outside section circumference of the reflecting cavity of the injection molding unit.
Figure 3:
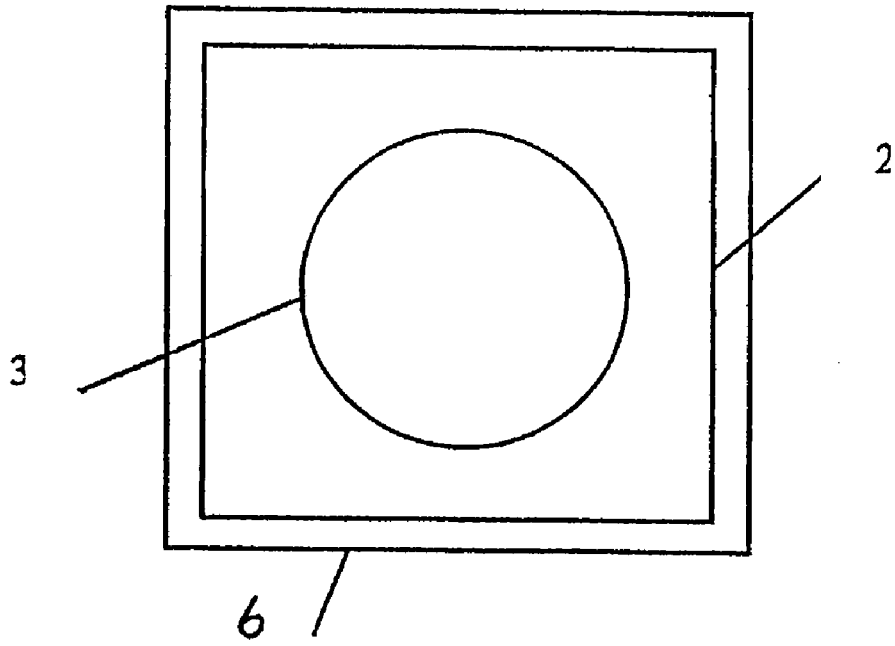
FIG. 3 is the breakdown figure sample of the outside section circumference of the reflecting cavity (1).
Figure 4:
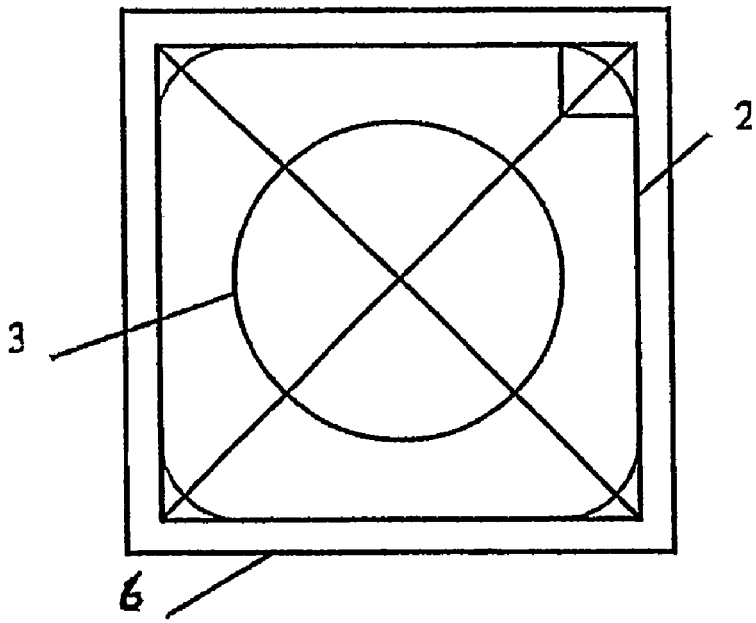
FIG. 4 is the breakdown figure sample of the outside section circumference of the reflecting cavity (2).

The key to the implementation of the invention is to determine the shape of the outside section circumference of the reflecting cavity. As indicated in FIG. 2, inside the boundary of the pixel physical area 6, the circumference of the outside section of the reflecting cavity 2 is the center symmetric planar close smooth curve in shape; the curve is completed as the following steps:

As indicated in FIG. 3, there is a square 2 with side length L determined from the center in the square pixel physical boundary 6 with the side length P (pitch), the space between the two square same sides is (P−L)/2;

As indicated in FIG. 4, the four corners of the inside square 2 are made curved, the center of a circle is taken from the point 1/N close to the square top corners along the line from the inside square 2 top corners to the square diagonal cross point $$\left(\text{length}\frac{\sqrt{2}}{2}\times L\right),$$

and draw a ¼ circle from the center of the circle to the point close to the side of the square 2, this square with round corners is used as a boundary of outside section of the light reflecting cavity of LED pixel.

According to simple geometric calculation, the luminance area ratio of LED matrix realized by the above method:

$$F=\left(1-\frac{4-\pi}{4N^2}\right)L^2/P^2$$

When P=6.33 mm, L=5 mm, N=1

$$F=(1-0.2146)\times 5^2/6.33^2=0.49$$

It was the luminance area ratio of Φ5 dot matrix (6.33 mm pitch) before the execution of the invention.

At that time, the maximum span of the black area between pixel dots of the adjacent two different lines and columns (diagonal line) is 3.95 mm.

If on the premise of P=6.33 mm, L=5.73 mm (the nearest pitch of the adjacent pixel luminous surface of 0.6 mm), N=4, the luminance area ratio:

$$F=(1-0.0134)\times 5.73^2/6.33^2=0.81$$

Thus, the maximum span of the black area between the pixel dots of the adjacent two different lines and columns (diagonal line) is just 1.44 mm.

It is thus clear that the luminance area ratio will increase greatly, the black area will reduce obviously, reaching the desired results.

The invention claimed is:

1. A LED matrix display module with high luminance area ratio comprising an injection molded unit and a printed board fitted therewith, wherein LEDs are regularly arranged in a matrix on the printed board, and each pixel dot is correspondingly provided with a reflecting cavity on the injection molded unit, with the reflecting cavity expanding gradually from an inside section to an outside section, circumference of the inside section of the reflecting cavity forms a closed and smooth circular curve, and circumference of the outside section of the reflecting cavity forms a closed and smooth curve, which is a square with round corners, and a side surface of the reflecting cavity is a smooth and curved surface.

2. The LED matrix display module with high luminance area ratio according to claim 1, wherein the circumference of the inside section of the reflecting cavity forms a closed and smooth curve that is a square with round corners.

* * * * *